United States Patent [19]

Speer, Sr.

[11] 4,204,673

[45] May 27, 1980

[54] DUAL-TREAD EXERCISER

[76] Inventor: John Speer, Sr., 1425 Bedford St., Stamford, Conn. 06905

[21] Appl. No.: 969,438

[22] Filed: Dec. 14, 1978

[51] Int. Cl.[2] ..... A63B 23/06

[52] U.S. Cl. ..... 272/69; 128/25 R; 198/817; 272/129; 272/DIG. 4

[58] Field of Search ..... 272/69, 70, 131, 132, 272/134, DIG. 4, 96, 97, 70.3, 116, 129; 128/25 R, 25 B; 198/817, 324; 104/25

[56] References Cited

U.S. PATENT DOCUMENTS

| | | | |
|---|---|---|---|
| 131,163 | 9/1872 | Hall | 198/817 X |
| 407,724 | 7/1889 | Davis | 198/817 X |
| 1,050,400 | 1/1913 | Steele | 198/817 |
| 1,192,832 | 7/1916 | Sherman | 198/817 X |
| 2,227,526 | 1/1941 | Wilson | 128/25 R |
| 2,765,786 | 10/1956 | Blong | 128/25 B X |
| 3,408,067 | 10/1968 | Armstrong | 272/97 X |
| 3,602,502 | 8/1971 | Hampl | 272/69 |
| 3,711,089 | 1/1973 | Reinhard | 272/97 |
| 3,941,377 | 3/1976 | Lie | 272/69 X |

FOREIGN PATENT DOCUMENTS

| | | | |
|---|---|---|---|
| 363648 | 2/1973 | U.S.S.R. | 198/324 |

*Primary Examiner*—Richard C. Pinkham
*Assistant Examiner*—Arnold W. Kramer
*Attorney, Agent, or Firm*—Charles F. Gunderson

[57] ABSTRACT

Exercising devices include rotatable treads and arm supports for using both the arms and the legs, and some of the exercising devices, particularly of the treadmill type having continuous treads, are for the exercise of the legs in a walking manner and position, but in a static condition. All of the treadmill exercisers have a unitary frame having two treadmills with two continuous treads, one for each foot, and may have corresponding, separate, coordinated hand or arm exercising functions due to moveable hand braces.

10 Claims, 6 Drawing Figures

DUAL-TREAD EXERCISER

BACKGROUND OF THE INVENTION

There are many types of exercisers for both arms and legs. Most of these are of the rope and pulley variety, with weights and/or springs to establish the load on the various limbs. This provides motion and tension of the muscles, but does not, accurately, imitate the process of walking, or provide real therapy in this area. Other exercisers are of the treadmill variety to give the function of walking without moving from a given location. This is often necessary or desirable where there is no convenient place to run or walk; or the weather is inclement; or the individual needs a controlled situation.

However, all of the treadmills have a single tread for both legs, and while they can be controlled in many ways, such as by raising the forward end of the treadmill, to provide a slope to climb against; or by friction mechanism that may provide a variable drag against the progress of the treadmill. Meters and other attachments may be provided to record the speed and the force utilized in the operation of the treadmill. However, none of the available treadmills can vary the load on either of the legs individually—or on the arms of the exerciser.

It is therefore an object of this invention to provide a treadmill having a separate, articulated tread for each of the legs of the user.

It is a further object of this invention to provide a dual treadmill wherein each of the treads can be controlled separately. The treads may, in fact, be controlled by separate motor-generators that may provide a supplemental force to either legs when energy is applied, or provide a given drag to either leg, when a load is applied for therapeutic purposes.

It is a further object of this invention to provide an exercise device that includes separate arm devices as well as separate leg devices that may all be individually controlled to supplement or attenuate the motions of both arms and legs.

SUMMARY OF THE INVENTION

Dual treadmills are provided in an exerciser to provide a separate control on the function of the separate legs of the user. The separate treadmills may provide a separate degree of drag, depending on the need for exercise of the separate legs, or may even be motor driven to reduce the work required of a given leg. Arm braces are also provided to support the user on the treadmills and may be coordinated to permit or require arm motion in conjunction with the leg motion.

DESCRIPTION OF THE PREFERRED EMBODIMENTS

Figure 1:
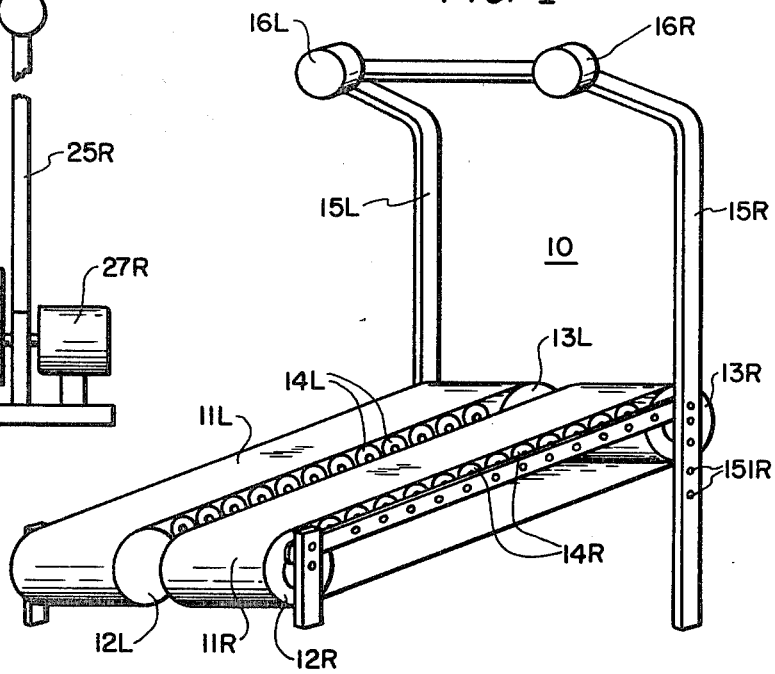
FIG. 1 shows an oblique view of the overall device.

Referring now more particularly to FIG. 1, an oblique view is seen of the device 10 having two treads

11L and 11R to separately accommodate the two feed of an individual. The treads are continuous and extend around rollers 12L and 12R at the rear end, and 13L and 13R at the front end. The upper surfaces of the treads are supported by the roller bearings 14L and 14R respectively. The rearmost rollers 12L and 12R are supported at ground level, but the foremost rollers 13L and 13R are elevated on the frame poles 15L and 15R through axels through any of a series of holes such as 151R.

Figure 2:
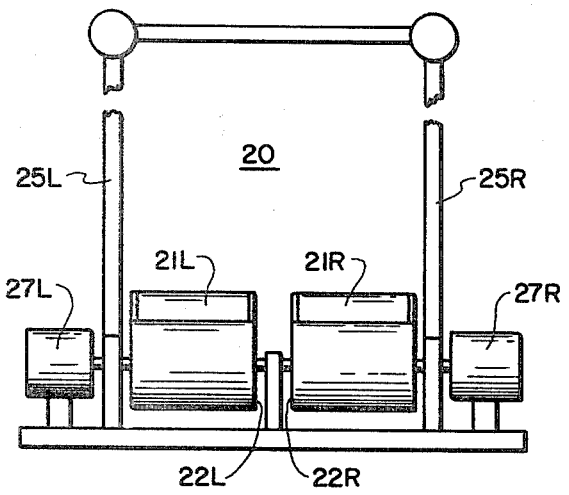
FIG. 2 shows an end view of a similar species of the device.

FIG. 2 shows an end view of a similar device 20 with treadmill treads 21L and 21R on rollers 22L and 22R respectively. In this species, motors 27L and 27R are shown connected to the axles of the corresponding rollers for providing individual control of the drive or drag of the corresponding treads.

Figure 3:
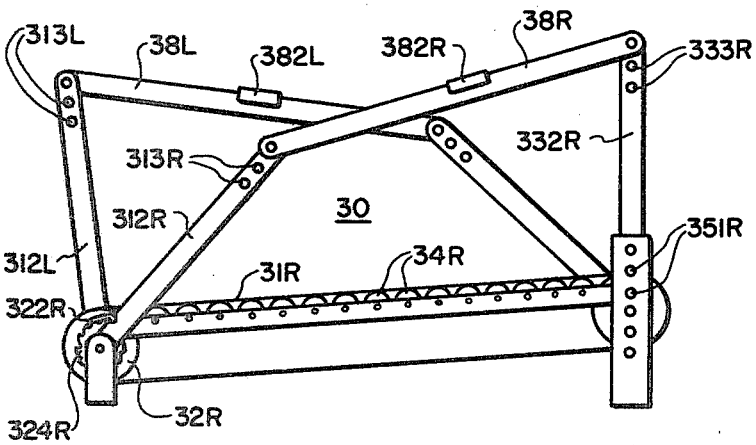
FIG. 3 shows a side view of another species of the device.

FIG. 3 shows a side view of another variation of this device, similar to the device of FIG. 1, and with similar elements similarly numbered, but with the addition of braces 38L and 38R, with handles 382L and 382R respectively, for arm support and exercise. These braces are coupled to rear supports 312L and 312R respectively by pivots 313L and 313R respectively. The fore ends of the braces are coupled to supports 332L and 332R by pivots 333L and 333R respectively. The rear supports 312L and 312R are coupled to the toe roller 32R by ratchets 322R and pawls 324R. The foremost rollers axles are set into one of the elevating sockets 351R.

Figure 4:
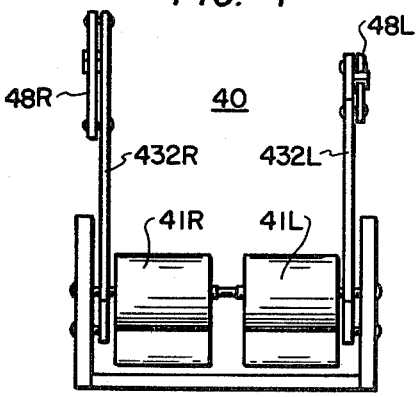
FIG. 4 shows an end view of the device of FIG. 3.

FIG. 4 shows a front view of the device of FIG. 3 with similar elements similarly numbered. The device 40 has the foremost supports 432L and 432R supporting the hand braces 48L and 48R respectively.

Figure 5:
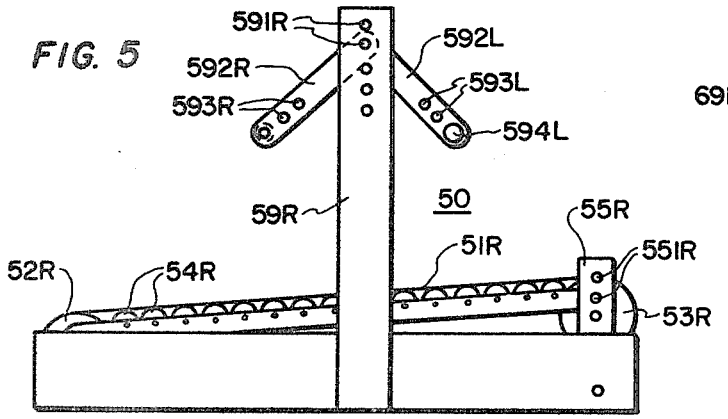
FIG. 5 shows a side view of still another species of this device.

FIG. 5 shows another variation of this device with similar elements again similarly numbered. In this species a central post 59R is seen with sockets 591R supporting pivot arms 592R with pivot arm sockets 593R supporting handles 594.

Figure 6:
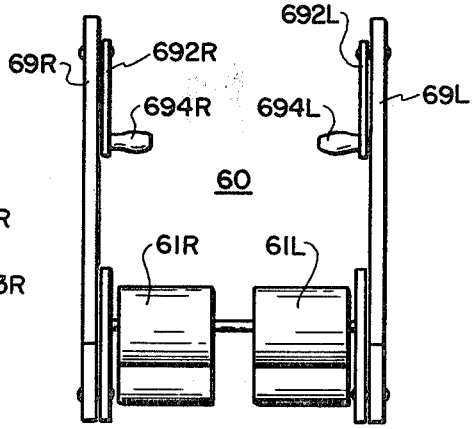
FIG. 6 shows an end view of the device of FIG. 5.

FIG. 6 shows a front view of the device of FIG. 5 with similar elements again similarly numbered. This figure shows more clearly the foremost supports 69L and 69R with pivot arms 692L and 692R supporting handles 694L and 694R respectively.

In operation, the individual stands with one foot on each of the separate treadmills, which may be adjusted to a normal walking resistance. This may be done by a combination of the height of the foremost end—to determine the angle of the slope of the treads—and by the drag or assistance applied to each of the treads. Such drag or assistance may be provided by the motor generators 27L and 27R of FIg. 2, and may be controlled at hand level by controls such as 16L and 16R for applying energy to the motors for assistance, or applying a load to the generators for drag in a well known manner.

The hand braces of FIG. 1 are stationary, and may steady the body while the feet and legs are exercising. However, the species of FIGS. 3 through 6 show variations wherein the arms support the body on moveable handles that may be coordinated with the motion of the corresponding treads to provide—or require—a normal swing of the arms in coordination with the movement of the legs on the treads.

FIGS. 3 and 4 show parallel bars or braces 38 that can move backward and forward. These may be locked in a central position if no motion of the arms is needed or desired, or they may be coupled, through the various supports, to gears the ratchets of well known types of supplement or coordinate the motion of the arms with that of the legs and feet along the treads.

FIGS. 5 and 6 show another arm-bracing mechanism with handles that may be locked in a central position or may move back and forth in a normal motion to simulate walking. Mechanism, not shown, may be provided here to couple the motion of the pivot arms and the rollers to couple the arm motion to the treads.

The essential feature of this invention is that each treadmill is separate, and can be separately regulated. A uniform treadmill motion can be provided by any of the prior art devices, and would be redundant here. This device performs the unique functon of providing separate control of the motion and the work or exercise allotted to each leg, from almost nil to the maximum. This is invaluable for a myriad of problems of individual requiring therapeutic treatment. For example, the effort of one leg can be a negligible amount at the beginning of therapy, and gradually increased to an amount equal to or greater than that of the other leg at the conclusion of the therapy.

The arms may not be used if this is not indicated, or they may be exercised to the extent that they need therapy, from a negligible amount to an exaggerated wing, and this may be coordinating with the motion of the treads. Continuous handrails could be provided and controlled in the same manner as that of the treads, but the simpler, reciprocal mechanism, as shown here, would serve the same purpose.

In any case, both the arm movement and the leg movement can be controlled separately in this device, in any manner or pattern that therapy may suggest, and these movements can be changed or varied at a moments notice to accommodate another individual with entirely different problems.

It is to be understood that I do not desire to be limited to the exact details of construction shown and described, for obvious modifications will occur to a person skilled in the art.

What is claimed is:

1. An exercising machine comprising a first treadmill having a first continuous tread for the left leg of the user; a second treadmill having a second continuous tread for the right leg of the user; means for supporting said first and second treadmills and treads parallel to, and adjacent to, each other for supporting the weight of the user thereon; a first means for independently controlling the motion of said first treadmill tread; a second means for controlling the motion of said second treadmill tread and operable independently of said first means; and arm support means extending above the plane of said treads for grasping by the user.

2. An exercising machine as in claim 1 having a means for adjusting the slope of said first and second treadmills.

3. An exercising machine as in claim 1 wherein said first and second means for independently controlling the motions of said treadmill treads comprises a first and a second means for applying friction independently to said first and second treadmills respectively, to vary the drag on each of said treadmill treads separately.

4. An exercising machine as in claim 1 wherein said first and second means for independently controlling the motions of said treadmill treads comprise a first motor-generator connected to said first treadmill; means for controlling said first motor-generator; a second motor-generator connected to said second treadmill; and means for controlling said second motor-generator.

5. An exercising machine as in claim 4 wherein said means for independently controlling said first and second motor generators comprise means for applying current independently to either of said motor-generators to assist the corresponding treadmill and tread.

6. An exercising machine as in claim 4 wherein said means for independently controlling said first and second motor-generators comprise means for applying a load to either of said motor-generators to load the corresponding treadmill.

7. An exercising machine as in claim 1 wherein said arm support means includes first and second hand braces and means for supporting said hand braces with respect to said treadmills.

8. An exercising machine as in claim 7 wherein said hand braces and said means for supporting said hand braces are moveable with respect to each other and with respect to said treadmills.

9. An exercising machine as in claim 8 wherein said means for supporting said first and second hand braces include means associated with each respective hand brace and its associated treadmill wherein the motions of said hand braces are coordinated with the motions of said treadmill treads to simulate arm and leg motion.

10. An exercise machine as in claim 7 having a first means for controlling the motion of said first hand brace with respect to its associated treadmill, and a second means for controlling the motion of said second hand brace with respect to its associated treadmill, to simulate arm motion corresponding to normal leg motion on operation of said treadmill treads.

* * * * *